US005526850A

United States Patent [19]

Sora et al.

[11] Patent Number: 5,526,850

[45] Date of Patent: Jun. 18, 1996

[54] MAIN NOZZLE ACCELERATOR CHAMBER FOR AN AIR-JET LOOM

[75] Inventors: Gianluigi Sora, Vicenza; Lucio Sardella, Schio; Roberto Capitanio, Castegnero, all of Italy

[73] Assignee: Nuovo Pignone S.p.A., Florence, Italy

[21] Appl. No.: 326,239

[22] Filed: Oct. 20, 1994

[30] Foreign Application Priority Data

Oct. 27, 1993 [IT] Italy ..... MI93A2275

[51] Int. Cl.[6] ..... D03D 47/30

[52] U.S. Cl. ..... 139/435.4; 28/273

[58] Field of Search ..... 139/435.4; 28/271–276; 57/279; 226/91, 97

[56] References Cited

U.S. PATENT DOCUMENTS

| | | | |
|---|---|---|---|
| 2,982,082 | 5/1961 | Pool | 28/273 X |
| 2,994,938 | 8/1961 | Loveland | 28/273 |
| 3,863,822 | 2/1975 | Keldany | 139/435.1 |
| 4,457,346 | 7/1984 | Nagashima | 139/435.4 |
| 4,552,188 | 11/1985 | Kuda | 139/435.4 |
| 4,813,460 | 3/1989 | Van Bogaert et al. | 139/435.4 |

FOREIGN PATENT DOCUMENTS

| | | |
|---|---|---|
| 904260 | 2/1986 | Belgium . |
| 3122139 | 5/1982 | Germany . |
| 8903512 | 5/1990 | Germany . |
| 545364 | 1/1974 | Switzerland . |
| WO82/01728 | 5/1982 | WIPO . |

*Primary Examiner*—Andy Falik

*Attorney, Agent, or Firm*—Oblon, Spivak, McClelland, Maier & Neustadt

[57] ABSTRACT

A main nozzle for an air jet loom has an outer casing and is provided with a compressed air introduction duct and a mixing chamber. A mixer tube provided with an annular distributor ring is inserted into the outer casing to form with the outer casing and annular distribution chamber upstream of the distributor ring and, downstream of the distributor ring, and annular accceleration chamber which feeds into the mixing chamber. The distributor ring has annularly arranged blowing slots. The acceleration chamber is formed by an outer conical wall provided on a portion of the inside of the outer casing and an inner conical wall provided on a portion of the mixing tube. The tapered walls of the annular acceleration chamber optimize the air jet used for inserting the weft into the shed. The inclination of the taper of the outer wall of the nozzle annular acceleration chamber is 12°–16°, and that of the inner wall is 4°–8°. In the preferred embodiment, the taper of the outer wall is 15° and that of the inner wall is 7°.

2 Claims, 1 Drawing Sheet

MAIN NOZZLE ACCELERATOR CHAMBER FOR AN AIR-JET LOOM

BACKGROUND OF THE INVENTION

1. Field of the Invention

This invention relates to a main nozzle for an air-jet loom which by suitable tapering of the inner and outer walls of its annular acceleration chamber optimizes the air jet used for inserting the weft into the shed.

2. Discussion of Background

As is well known, in air-jet weaving the weft yarn is inserted into the shed by hydrodynamic coupling between the yarn to be inserted and an air jet, i.e. by transmitting to the weft yarn the entrainment kinetic energy of an air jet generated by a main nozzle.

Various types of main nozzles are already known from the state of the art, all substantially comprising an outer casing provided with a compressed air introduction duct and mixing chamber, and a mixer tube provided with a distributor ring comprising annularly arranged blowing slots and inserted into said outer casing, to form with this latter an annular distribution chamber upstream of said distributor ring and, downstream of said ring, an annular acceleration chamber with conical walls which feeds into said mixing chamber.

It is apparent that with such a construction the cone of the outer wall of said acceleration chamber cannot subtend too large an angle because the annular air jet emerging from said annular blowing slots of said distributor ring would lose too much of its energy in striking against said wall. Neither can said angle be too small otherwise the nozzle will be too long axially, this being a considerable drawback in the case of air-jet looms.

SUMMARY OF THE INVENTION

Experimental tests have shown that the smallest energy loss by the air jet is achieved with an inclination of the taper of the outer wall of the acceleration chamber of between 12° and 16°.

Experimental tests have also shown that maximum efficiency in transferring energy from the air jet to the weft to be inserted by the main nozzle having said inclination of the taper of the acceleration chamber outer wall is achieved with an inclination of the taper of the inner wall of said acceleration chamber of between 4° and 8°.

Hence, the main nozzle for an air-jet loom, comprising an outer casing provided with a compressed air introduction duct and mixing chamber, and a mixer tube provided with a distributor ring comprising annularly arranged blowing slots and inserted into said outer casing, to form with this latter an annular distribution chamber upstream of said distributor ring and, downstream of said ring, an annular acceleration chamber with conical walls which feeds into said mixing chamber, is characterised according to the present invention in that the inclination of the taper of the outer wall of said annular acceleration chamber is between 12° and 16°, and that of the inner wall is between 4° and 8°.

According to a preferred embodiment of the present invention, the inclination of the taper of the outer wall of said annular acceleration chamber is 15° and that of the inner wall is 7°.

BRIEF DESCRIPTION OF THE DRAWING

The invention is described in detail hereinafter with reference to the accompanying drawing, which shows a preferred embodiment thereof by way of non-limiting example in that technical and constructional modifications can be made thereto without leaving the scope of the present invention.

DESCRIPTION OF THE PREFERRED EMBODIMENT

Figure 1:
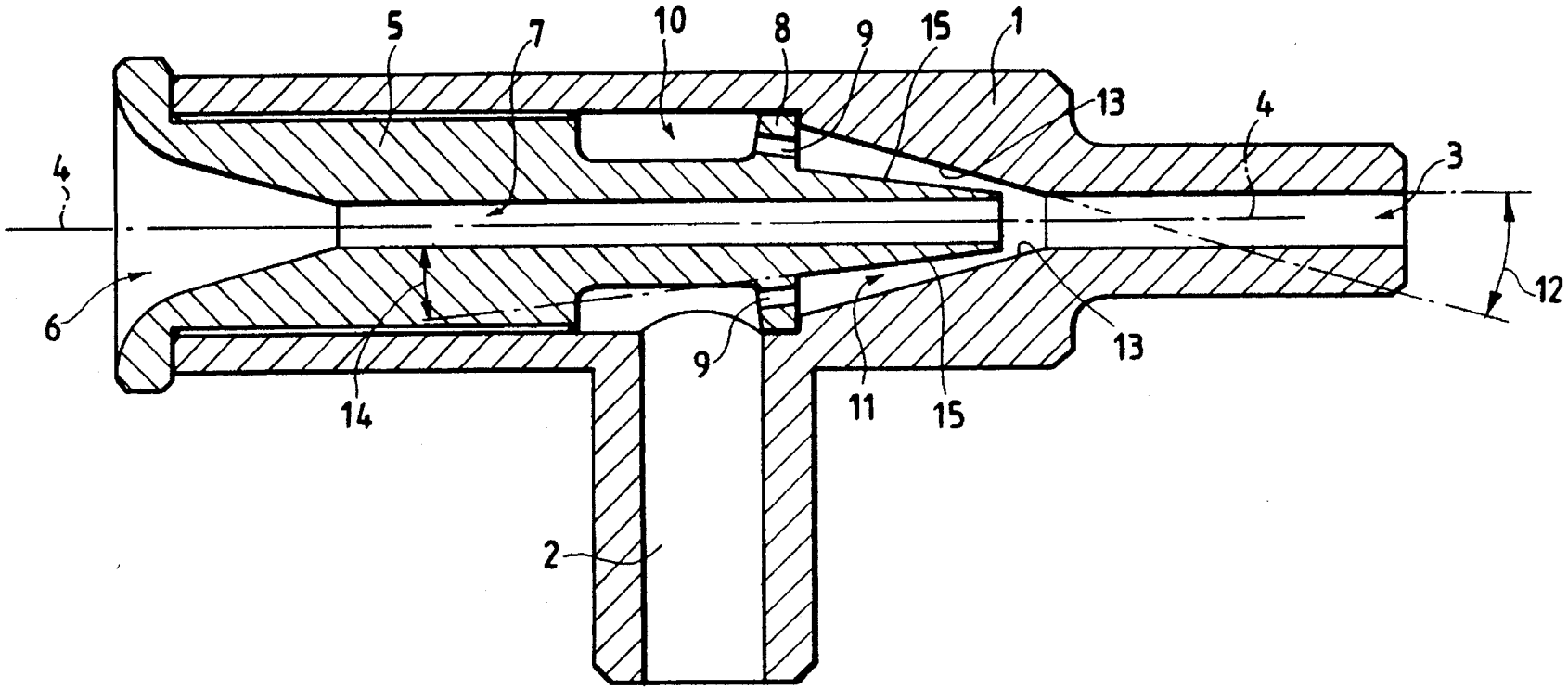

On said drawing, the FIGURE shows a longitudinal section through a main nozzle formed in accordance with the invention.

In the FIGURE the reference numeral 1 indicates the main nozzle outer casing, which is provided with the compressed air feed duct 2 and forms the mixing chamber 3 in which the weft yarn 4 comes into contact with the air jet and is entrained thereby. A mixer tube 5, screwed into the casing 1, comprises a widened mouth 6 to facilitate insertion of the weft yarn 4, a central channel 7 for said yarn, and a distributor ring 8 provided with slots 9 arranged annularly to create an annular air jet uniformly distributed about the weft yarn 4. Said mixer tube 5 forms with said casing 1, upstream and downstream of said distributor ring 8 respectively, an annular distribution chamber 10 connected to the duct 2, and an annular acceleration chamber 11 having conical walls to accelerate said annular air jet and connected to said mixing chamber 3. The inclination 12 of the taper of the outer wall 13 of said annular acceleration chamber 11 is between 12° and 16°, and is preferably 15°. The inclination 14 of the taper of the inner wall 15 of the annular acceleration chamber 11 is between 4° and 8°, and is preferably 7°.

What is claimed as new and desired to be secured by Letters Patent of the United States is:

1. A main nozzle for an air-jet loom, comprising an outer casing provided with a compressed air introduction duct and mixing chamber, and a mixer tube provided with a distributor ring inserted into said outer casing to form with said outer casing an annular distribution chamber upstream of said distributor ring and, downstream of said distributor ring, an annular acceleration chamber which feeds into said mixing chamber, said distributor ring comprising annularly arranged blowing slots, said annular acceleration chamber comprising an outer conical wall formed by a portion of said outer casing and an inner conical wall formed by a portion of said mixer tube, said outer conical wall and said inner conical wall each being formed so as to taper inwardly from said annularly arranged blowing slots to said mixing chamber, wherein the inclination of said taper of said outer conical wall of said acceleration chamber is between 12 ° and 16°, and that of said inner conical wall is between 4° and 8°.

2. A main nozzle for an air-jet loom as claimed in claim 1, wherein the inclination of said taper of said outer conical wall of said annular acceleration chamber is 15° and that of said inner conical wall is 7°.

* * * * *